US011559159B2

(12) United States Patent
Brusilovsky

(10) Patent No.: US 11,559,159 B2
(45) Date of Patent: Jan. 24, 2023

(54) CLOTHING HANGER FOLD-QUICK-RELEASE

(71) Applicant: Alexander V. Brusilovsky, Foothill Ranch, CA (US)

(72) Inventor: Alexander V. Brusilovsky, Foothill Ranch, CA (US)

( * ) Notice: Subject to any disclaimer, the term of this patent is extended or adjusted under 35 U.S.C. 154(b) by 6 days.

(21) Appl. No.: 17/012,553

(22) Filed: Sep. 4, 2020

(65) Prior Publication Data

US 2022/0031103 A1 Feb. 3, 2022

Related U.S. Application Data

(60) Provisional application No. 63/060,606, filed on Aug. 3, 2020.

(51) Int. Cl.
*A47G 25/40* (2006.01)
*A47G 25/28* (2006.01)

(52) U.S. Cl.
CPC ..... *A47G 25/4023* (2013.01); *A47G 25/28* (2013.01)

(58) Field of Classification Search
CPC .... A47G 25/28; A47G 25/40; A47G 25/4023; A47G 25/403; A47G 25/4046; A47G 25/14; A47G 25/4015; A47G 25/4038; A47G 25/4092
See application file for complete search history.

(56) References Cited

U.S. PATENT DOCUMENTS 949,815 A * 2/1910 Anderson ..... A47G 25/4023 223/90
1,020,608 A * 3/1912 Hunt ..... A47G 25/4023 223/90
1,101,088 A * 6/1914 Olson ..... A47G 25/4023 223/89
1,216,447 A * 2/1917 Harris ..... A47G 25/4023 223/89
1,241,346 A * 9/1917 Dalton ..... A47G 25/4023 223/90
1,248,602 A * 12/1917 Belasco et al. .... A47G 25/4023 223/90
1,258,452 A * 3/1918 Pierce ..... A47G 25/4023 223/89

(Continued)

FOREIGN PATENT DOCUMENTS

DE 29504101 U1 * 8/1995
EP 1817989 8/2007

(Continued)

*Primary Examiner* — F Griffin Hall
(74) *Attorney, Agent, or Firm* — Morland C. Fischer

(57) ABSTRACT

The inventive subject matter provides a device being capable of hanging a cloth with minimum effort on the part of a user, and with less potential damage on item being hung. In general, the inventive hanger comprises an upper coupling, left and right arms extending laterally away from opposite sides of the upper coupling. The arms are further coupled with a lower coupling, at least one of the couplings includes a pivot that allows the lower coupling to move closer to the upper coupling, allowing the hanger to easily adapt to fit into the neck of a shirt without stretching out the neck. A biasing component biases the lower coupling away from the upper coupling, allowing the hanger to keep the shirt hanged on.

7 Claims, 7 Drawing Sheets

(56) References Cited

U.S. PATENT DOCUMENTS 1,273,253 A * 7/1918 McGinnis ..... A47G 25/4023 223/90
1,278,054 A * 9/1918 Strand ..... A47G 25/4023 223/89
1,345,017 A * 6/1920 McGinnis ..... A47G 25/4023 223/90
1,351,516 A * 8/1920 Hoffman ..... A47G 25/4023 223/89
1,370,713 A * 3/1921 Strand ..... A47G 25/4023 223/89
1,444,525 A * 2/1923 Rosenthal ..... A47G 25/4023 223/89
1,458,113 A * 6/1923 Sommer ..... A47G 25/4023 223/89
1,458,114 A * 6/1923 Sommer ..... A47G 25/4023 223/90
1,682,626 A * 8/1928 Peckham ..... A47G 25/4023 223/89
2,108,622 A * 2/1938 Strezoff ..... A47G 25/4023 223/89
2,137,700 A * 11/1938 Reehl ..... A47G 25/4023 223/94
2,232,249 A * 2/1941 Losin ..... A47G 25/4023 223/89
2,413,221 A * 12/1946 Elston ..... A47G 25/4023 223/89
2,418,870 A * 4/1947 Crowder ..... A47G 25/4023 223/89
2,475,831 A * 7/1949 Fowler ..... A47G 25/4023 223/89
2,544,170 A * 3/1951 Mills ..... A47G 25/4023 223/89
2,595,026 A * 4/1952 Varker ..... A47G 25/4023 223/94
2,605,942 A * 8/1952 Warren ..... A47G 25/4023 223/89
2,754,038 A * 7/1956 Varker ..... A47G 25/4023 223/94
3,645,426 A * 2/1972 Glascock ..... A47G 25/447 223/89
5,044,534 A * 9/1991 Hwang ..... A47G 25/4023 223/89
6,050,460 A * 4/2000 Licari ..... A47G 25/4023 223/94
7,172,102 B2 * 2/2007 Lewien ..... A47G 25/4023 223/89
7,185,795 B1 * 3/2007 Wallick ..... A47G 25/08 223/89
8,459,514 B2 * 6/2013 Lagzdins ..... A47G 25/4023 223/89
8,485,328 B2 * 7/2013 Valcarenghi ..... A47G 25/4023 190/102
9,247,838 B2 * 2/2016 Kallet ..... A47G 25/4023
10,342,372 B2 * 7/2019 Farris ..... F16B 7/105
10,856,684 B2 * 12/2020 Mauri ..... A47G 25/4053
2015/0230644 A1 * 8/2015 Kallet ..... A47G 25/487 223/96
2016/0022076 A1 * 1/2016 Yip ..... A47G 25/4061 223/94
2019/0298094 A1 * 10/2019 Wright ..... A47G 25/4023

FOREIGN PATENT DOCUMENTS

FR 611469 A * 9/1926
FR 685236 A * 7/1930
FR 812278 A * 5/1937
FR 935728 A * 6/1948
FR 1558353 A * 2/1969 ..... A47G 25/28
GB 679037 A * 10/1952
WO WO-0015087 A1 * 3/2000 ..... A47G 25/4023

* cited by examiner

CLOTHING HANGER FOLD-QUICK-RELEASE

The present invention relates to a device for hanging shirts and other clothing. In the case of shirts, the device facilitated hanging without stretching a neck portion of the shirt. The device is designed to be opened and closed by one hand without extra steps.

BACKGROUND

The following description includes information that may be useful in understanding the present invention. It is not an admission that any of the information provided herein is prior art or relevant to the presently claimed invention, or that any publication specifically or implicitly referenced is prior art.

A basic problem for hanging shirts is that from time to time the neck is too small to conveniently insert a hanger from above. One could unbutton the top one or two buttons, or in the case of a shirt without buttons, one could stretch out the neck of the shirt. Either solution is undesirable.

European patent, EP1817989A1 to Ferrarini describes a clothing hanger with pivoting arms. That solution, however, is problematic because weight of the shirt can force inadvertent closure. One can use a stopper of some sort to prevent closure, but that introduces an extra step, and extra complexity.

The '989 patent is incorporated by reference herein. Where a definition or use of a term in the incorporated reference is inconsistent or contrary to the definition of that term provided herein, the definition of that term provided herein applies and the definition of that term in the reference does not apply.

Thus, there is still a need for a pragmatic hanger requiring only minimum effort for a user to hang a shirt or other item of clothing.

SUMMARY OF THE INVENTION

The inventive subject matter provides a device being capable of hanging a cloth with minimum effort on the part of a user, and with less potential damage on item being hung.

In general, the inventive hanger comprises an upper coupling, left and right arms extending laterally away from opposite sides of the upper coupling. The arms are further coupled with a lower coupling, at least one of the couplings includes a pivot that allows the lower coupling to move closer to the upper coupling. A biasing component biases the lower coupling away from the upper coupling.

In preferred embodiments, at least one of the arms is resiliently flexible, and operates as the biasing component. Additionally or alternatively, a different biasing component can be used including a spring.

Flexibility of one or both of the arms is sufficient to allow the lower coupling to travel at least 2 cm closer to the upper coupling. The arms can be any suitable length, and can include a bend such that either or both of the arms extend all the way from the upper coupling to the lower coupling. Alternatively, either or both of the arms can telescope to effectively adjust the overall side to side length of the hanger.

In some embodiments, the arms and/or couplings can be user disassembled and reassembled in a non-destructive manner.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Also as used herein, the meaning of the terms "a," "an," and "the" includes plural forms unless the context clearly dictates otherwise, and the meaning of the term "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a right embodiment comprises elements B and D, then the inventive subject matter is also considered to include other remaining combinations of A, B, C, or D, even if not explicitly disclosed.

The recitation of ranges of values herein is merely intended to serve as a shorthand method of referring individually to each intermediate value falling within the range. Unless the context dictates the contrary, all ranges set forth herein should be interpreted as being inclusive of their endpoints, and open-ended ranges should be interpreted to include only commercially practical values.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The present invention describes a clothing hanger to be used to hang a cloth with a user's minimum effort.

Figure 1:
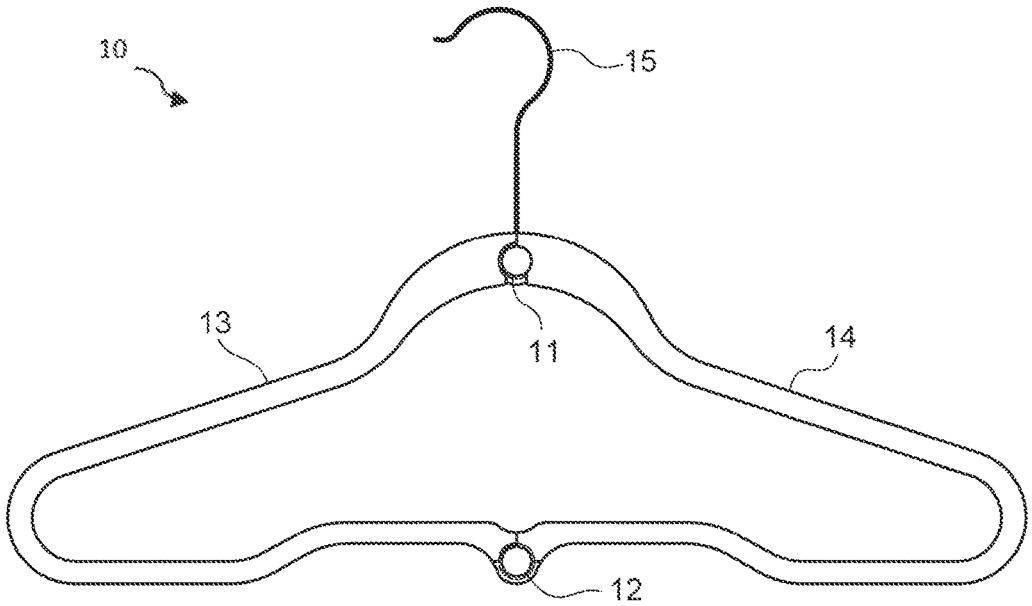
FIG. 1 is a plan view of an embodiment of a clothing hanger.

FIG. 1 depicts an exemplary clothing hanger 10. The hanger generally has a curved coupling 15, and left and right arms 13, 14 that extend from the upper couplings 11. The arms 13, 14 are further coupled (directly or indirectly) with the lower coupling 12. Upper 11 and lower 12 couplings comprise pivots 25*a*, 25*b*, respectively, allowing the left and the right members to rotate about the respective axes of the pivots.

Figure 2:
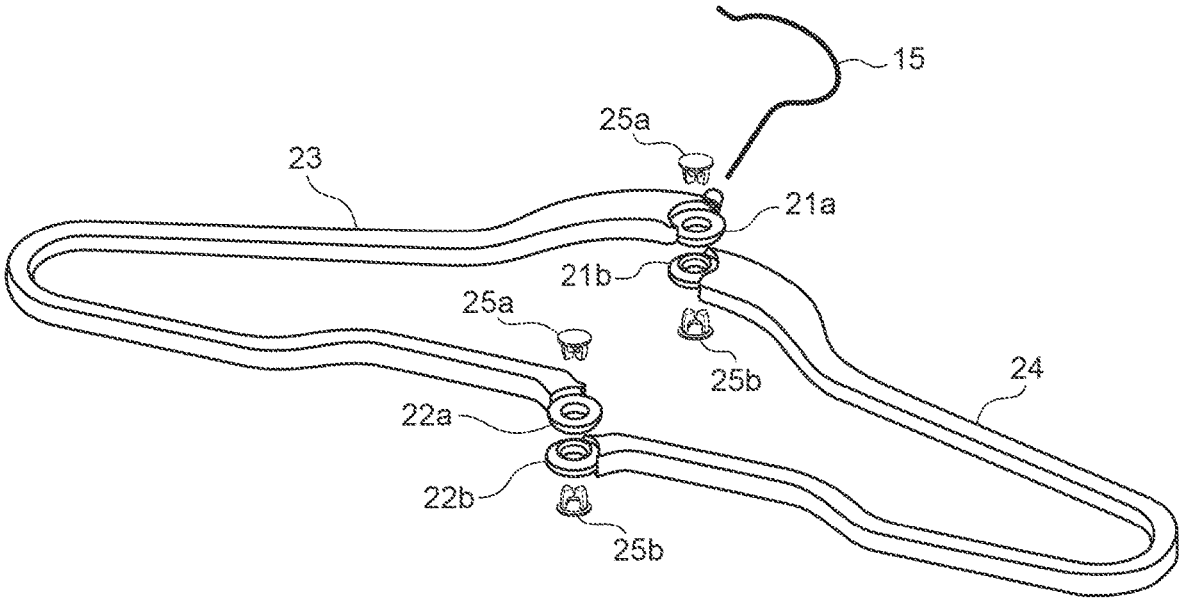
FIG. 2 is a perspective disassembled view of the clothing hanger of FIG. 1.

FIG. 2 shows a disassembled depiction of the clothing hanger 10 of FIG. 1. Upper coupling 11 includes user-disassemblable components 21*a* and 21*b*, which collectively operate as an upper pivot. Lower coupling 12 includes user-disassemblable components 22*a* and 22*b*, which collectively operate as a lower pivot. Disassembling allows hanger 10 to fit more conveniently into a small suitcase or bag.

Figure 3A:
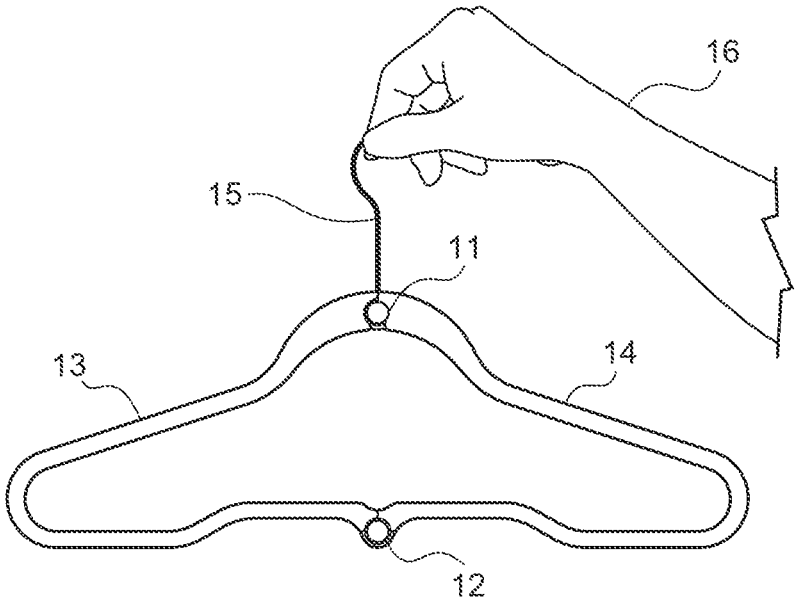
FIGS. 3A and 3B are plan views of the clothing hanger of FIG. 1, in opened (3A) and closed (3B) configurations.
Figure 3B:
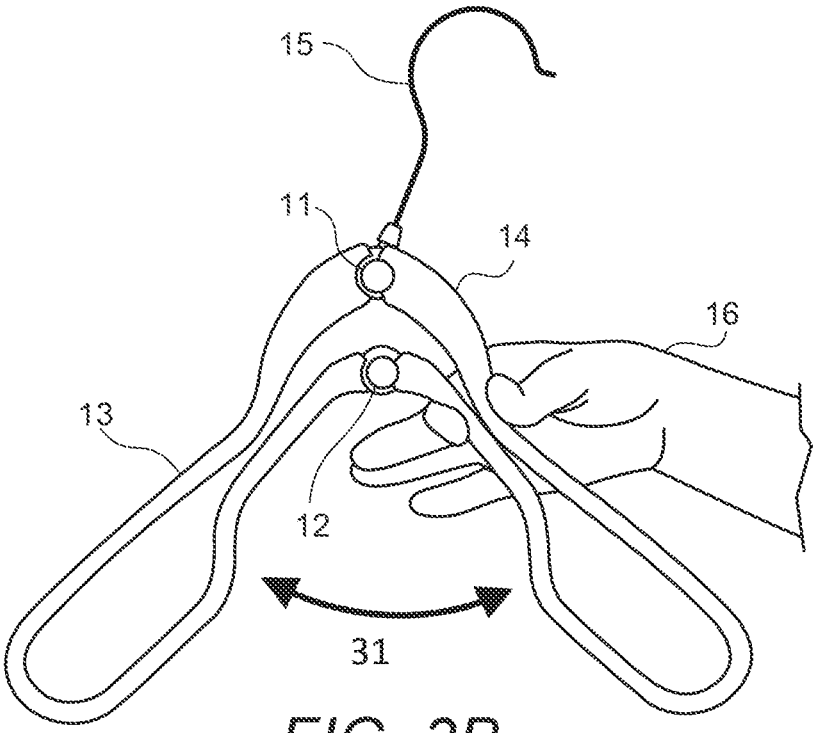

FIGS. 3A and 3B show how a user (depicted in part by hand 16) can easily bend one of the arms to move the upper and lower couplings 11, 12 closer together, thereby effectively reducing the overall length of the hanger 10. Such motion also reduces the angle 31 between the arms to 90 degrees or less.

The resilient characteristic of one or both of the arms 13, 14 allows the hanger 10 to repeatedly transition between opened and closed configurations, and also operates to bias the upper and lower couplings 11, 12 away from each other.

Figure 4A:
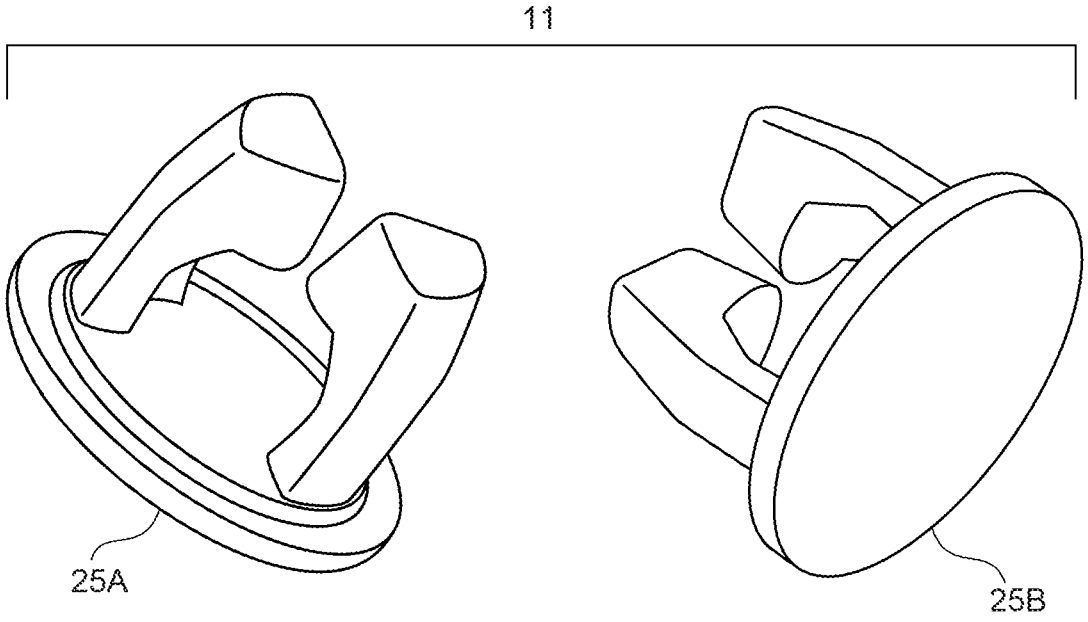
FIGS. 4A and 4B are perspective views of a pivot of the hanger of FIG. 1, in disassembled (4A) and assembled (4B) configurations.
Figure 4B:
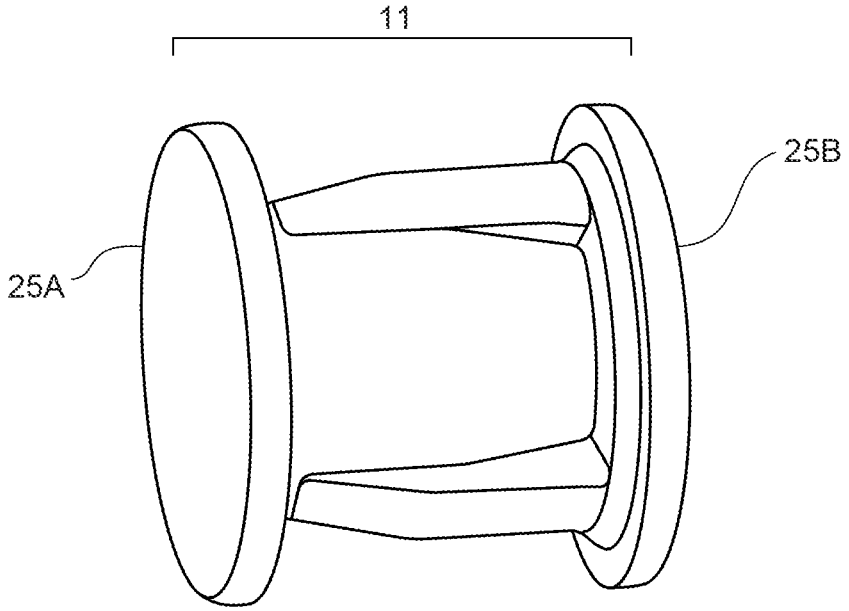

FIGS. 4A and 4B show detail of components 25A, 25B that effectively comprise the pivot pin of pivot of 11. Components 25A, 25A are configured to mate in a manner that can be non-destructively snapped together and apart.

Figure 5A:
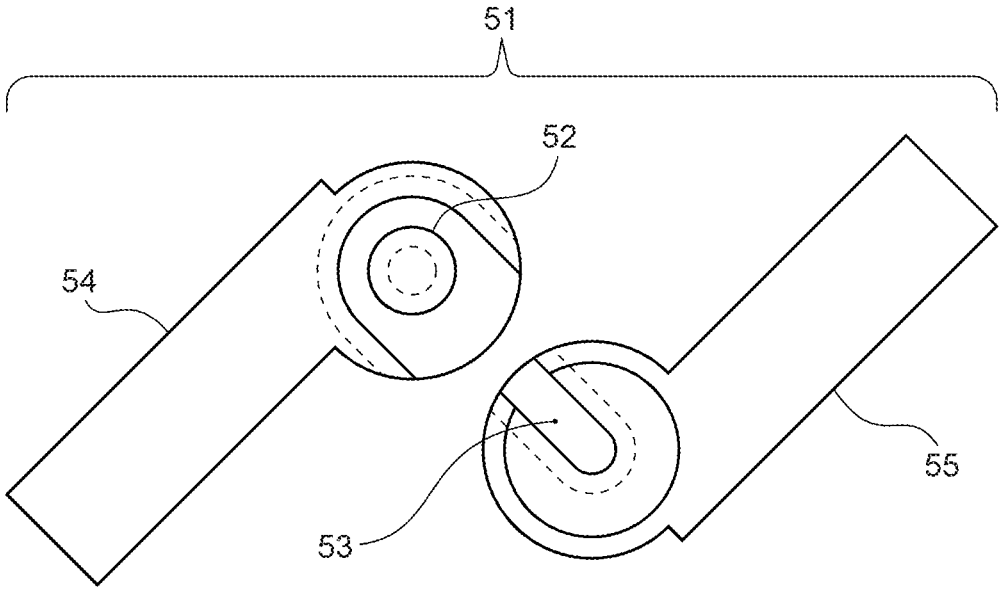
FIGS. 5A and 5B are perspective views of an alternative pivot, in disassembled (5A) and assembled (5B) configurations.
Figure 5B:
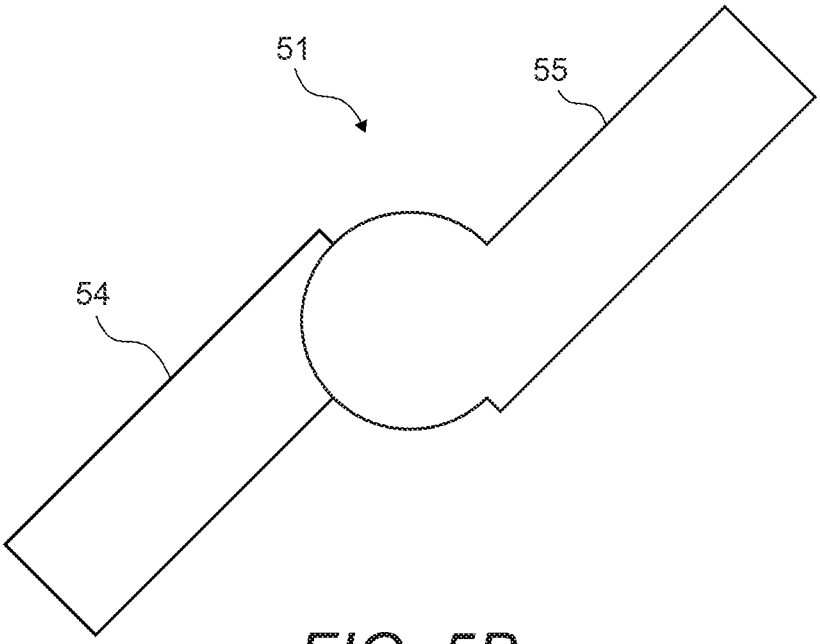

FIGS. 5A and 5B show an alternative pivot 51, comprising mating pieces 54, 55 that slide together, with pivot pin 52 non-destructively slidable into and out of channel 53. Pieces 54, 55 can be integral with arms extending out from the upper or lower couplings.

Figure 6A:
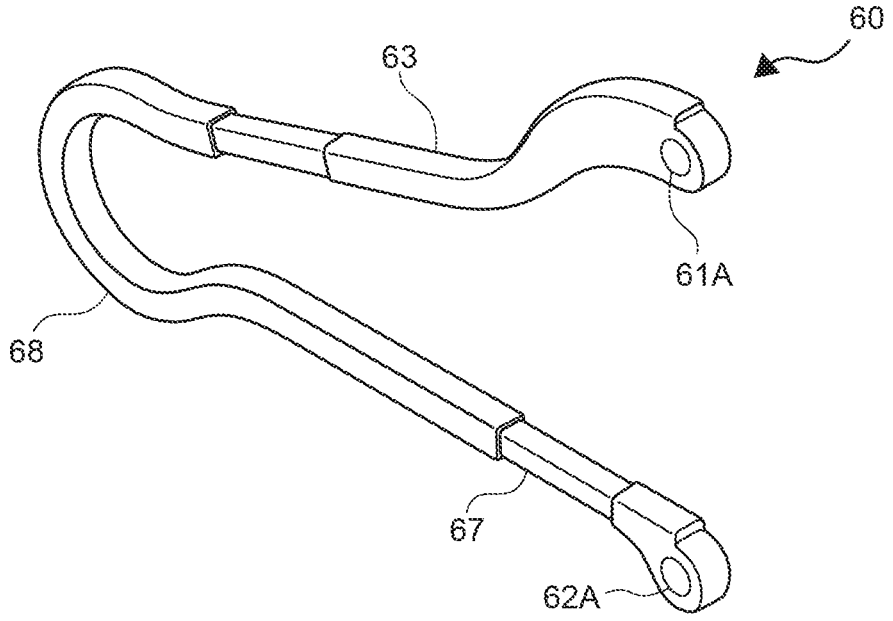
FIGS. 6A and 6B are perspective views of an extensible clothing hanger.
Figure 6B:
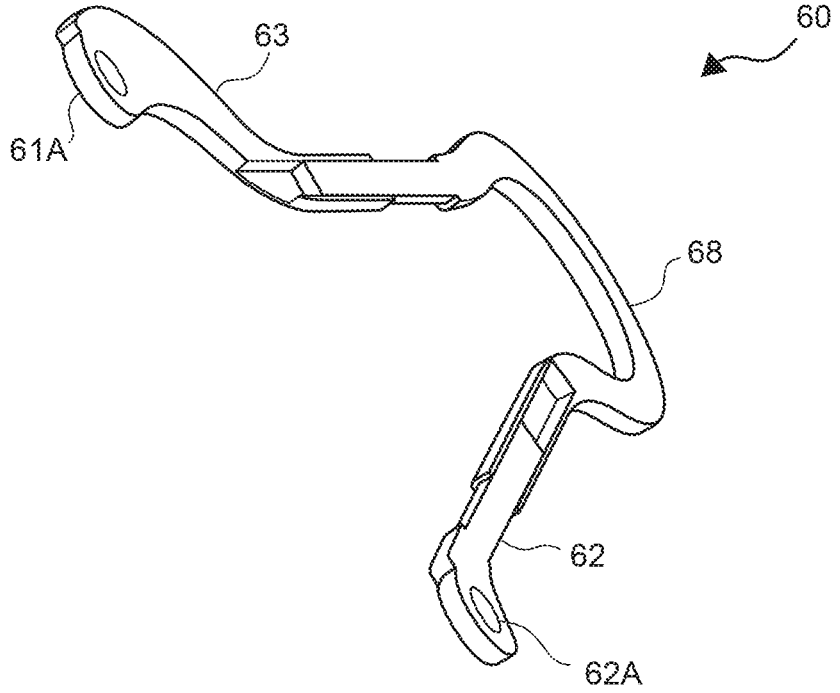

FIGS. 6A and 6B show an embodiment of an arm 60 of an alternative clothing hanger. Arm 63 generally comprises an upper member 63, a lower member 67, and an intermediate member 68 that is slidably coupled with the upper 63 and lower members 67. In some embodiments the degree of sliding is such that the length of the hanger can be laterally adjusted to be functional from child to adult clothing. Intermediate member 68 is resiliently flexible.

Figure 7A:
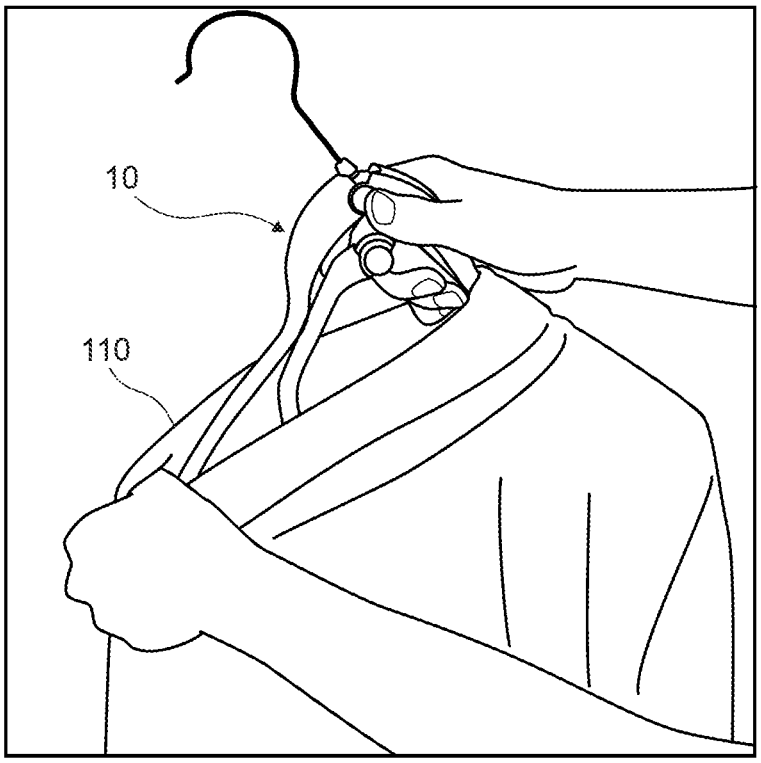
FIGS. 7A and 7B compare uses of the clothing hanger of FIG. 1 with that of a typical clothing hanger.
Figure 7B:
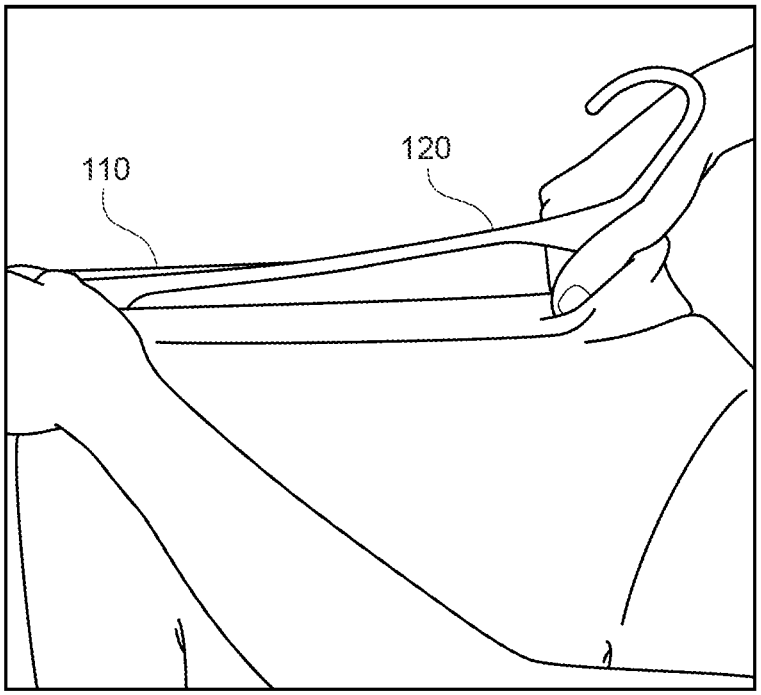

FIGS. 7A and 7B contrasts intended use of the hanger 10 of FIGS. 1, 2, 3A and 3B with that of a typical clothing hanger 100. As should be apparent, hanger 10 is easily adapted to fit into the neck of a shirt 110 without stretching out the neck.

Figure 8A:
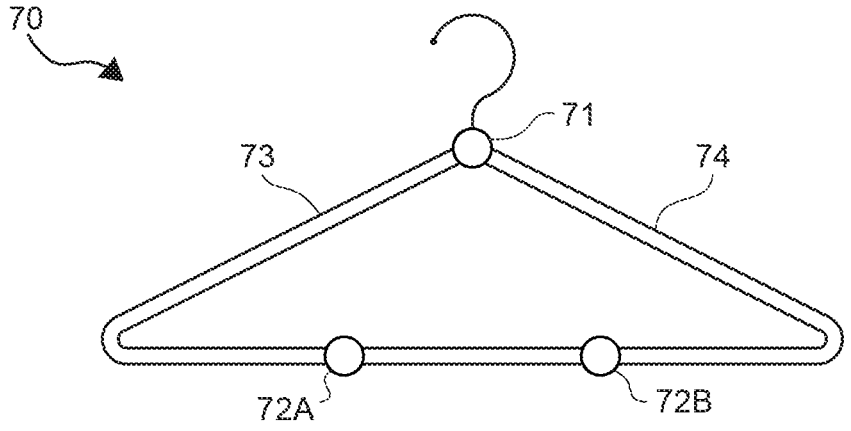
FIG. 8A-8C show other embodiments of a clothing hanger.
Figure 8B:
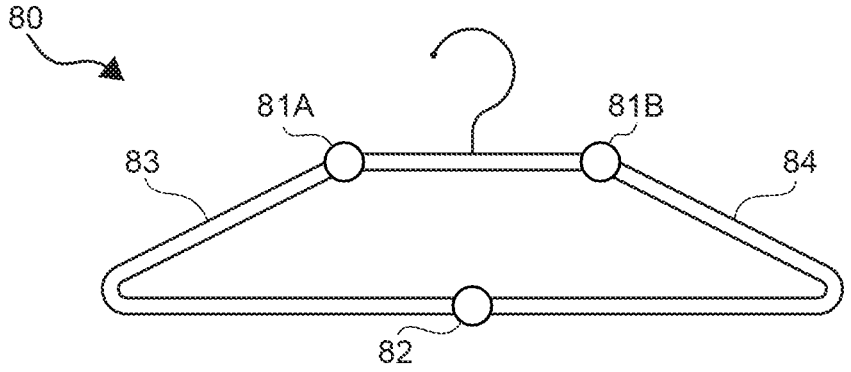
Figure 8C:
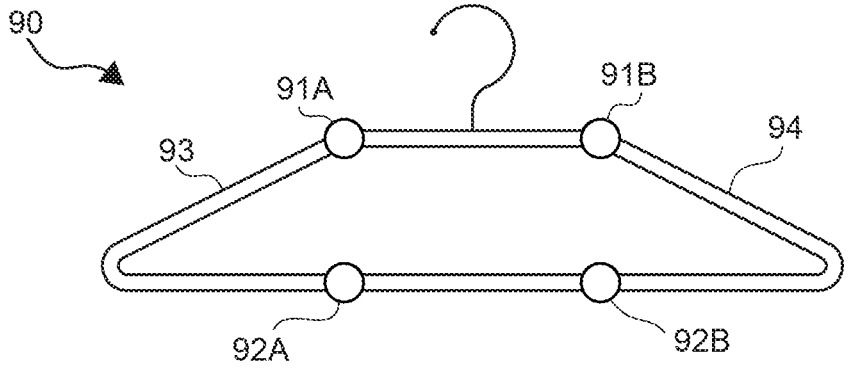

FIG. 8A-8C show alternative embodiments contemplated herein. FIG. 8A shows hanger 70 having a single pivot 71 as an upper coupling, left and right arms 73, 74 bending around to couple with two lower pivots 72A, 72B collectively operating as a lower coupling. FIG. 8B shows hanger 80 having two upper pivots 81A, 81B collectively operating at an upper coupling, and left and right arms 83, 84 bending around to couple with a single lower pivot 83 operating as a lower coupling. FIG. 8C shows hanger 90 having a two upper pivots 91A, 91B collectively operating as an upper coupling, and left and right arms 93, 94 bending around to couple with two lower pivots 92A, 92B, collectively operating as a lower pivot. It is also possible to have more than two pivots operating as upper or lower couplings.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A clothes hanger comprising:

an upper left arm having first and opposite ends;

an upper right arm having first and opposite ends;

an upper coupling at which the first end of said upper left arm is connected to the first end of said upper right arm such that said upper left arm and said upper right arm are pivotally connected together at said upper coupling;

a lower left arm having first and opposite ends;

a lower right arm having first and opposite ends;

a lower coupling at which the first end of said lower left arm is pivotally connected to the first end of said lower right arm;

a first resiliently flexible turn at which the opposite end of said upper left arm is joined to the opposite end of said lower left arm;

a second resiliently flexible turn at which the opposite end of said upper right arm is joined to the opposite end of said lower right arm;

said upper left and said upper right arms responding to a downward pushing force applied to either one of said upper left arm or said upper right arm by rotating downwardly with one another at said upper coupling and moving towards said lower left and said lower right arms, and said lower left and said lower right arms responding to an upward pushing force applied thereto by rotating upwardly with one another at said lower coupling and moving towards said upper left and said upper right arms from an open configuration spaced from said upper left and said upper right arms to a closed configuration lying closer to said upper left and said upper right arms, whereby said first and second resiliently flexible turns are bent and said upper and lower couplings are located one above the other, and said upper left and said upper right arms being biased by said first and second resiliently flexible turns to automatically rotate upwardly with one another at said upper coupling so as to move away from said lower left and said lower right arms when the downward pushing force applied to said upper left or said upper right arms is terminated, and said lower left and said lower right arms also being biased by said first and second resiliently flexible turns to automatically rotate downwardly with one another at said lower coupling so as to move away from said upper left and said upper right anus from said closed configuration to said open configuration when the pushing force applied to said lower left and said lower right arms is terminated and said first and second resiliently flexible turns relax.

2. The clothes hanger recited in claim 1, wherein the opposite end of said upper left arm is continuously connected to the opposite end of said lower left arm by way of said first resiliently flexible turn, and the opposite end of said upper right arm is continuously connected to the opposite end of said lower right arm b way of said second resiliently flexible turn.

3. The clothes hanger recited in claim 1, wherein said upper left arm, said upper right arm, said lower left arm and said lower right arm are interconnected with one another by only said upper and said lower couplings.

4. The clothes hanger recited in claim 1, wherein said upper coupling is a pivot.

5. The clothes hanger recited in claim 1, wherein said lower coupling is a pivot.

6. The clothes hanger recited in claim 1, wherein each of the upper and lower couplings includes mating male and female pieces configured to be snapped together and pulled apart.

7. The clothes hanger recited in claim 1, wherein each of the upper and lower couplings includes mating male and female pieces configured to slide together and be pulled apart.

* * * * *